US008973949B2

(12) United States Patent
Lamboy

(10) Patent No.: US 8,973,949 B2
(45) Date of Patent: Mar. 10, 2015

(54) LABEL, PACKAGING, USE OF AN ADHESIVE LABEL AND METHOD OF PROVIDING A TEST SAMPLE

(75) Inventor: Peter Lamboy, Weiterstadt (DE)

(73) Assignee: KAO Germany GmbH, Darmstadt (DE)

( * ) Notice: Subject to any disclaimer, the term of this patent is extended or adjusted under 35 U.S.C. 154(b) by 268 days.

(21) Appl. No.: 13/505,928

(22) PCT Filed: Nov. 15, 2010

(86) PCT No.: PCT/EP2010/067487
§ 371 (c)(1),
(2), (4) Date: May 3, 2012

(87) PCT Pub. No.: WO2011/061149
PCT Pub. Date: May 26, 2011

(65) Prior Publication Data

US 2012/0222982 A1 Sep. 6, 2012

(30) Foreign Application Priority Data

Nov. 18, 2009 (EP) ..... 09176268

(51) Int. Cl.
*B42D 15/00* (2006.01)
*G09F 3/00* (2006.01)

(52) U.S. Cl.
CPC ..... *G09F 3/0297* (2013.01); *G09F 3/0292* (2013.01)
USPC ..... 283/81; 283/103; 283/105; 283/111

(58) Field of Classification Search
USPC ..... 283/103, 105, 81, 111
See application file for complete search history.

(56) References Cited

U.S. PATENT DOCUMENTS

| | | | | |
|---|---|---|---|---|
| 4,268,983 | A * | 5/1981 | Cook | 40/630 |
| 5,084,143 | A | 1/1992 | Smith | |
| 5,411,295 | A | 5/1995 | Bates | |
| 5,873,607 | A * | 2/1999 | Waggoner | 283/81 |
| 6,358,607 | B1 * | 3/2002 | Grotzner et al. | 283/81 |
| 6,447,014 | B1 | 9/2002 | Seidl | |
| 2001/0005570 | A1 * | 6/2001 | Daniel et al. | 359/2 |
| 2005/0230960 | A1 * | 10/2005 | Bilodeau et al. | 283/75 |
| 2007/0085336 | A1 * | 4/2007 | Doermer | 283/81 |
| 2011/0123753 | A1 * | 5/2011 | Koger et al. | 428/40.1 |

FOREIGN PATENT DOCUMENTS

WO 93/19445 A1 9/1993

OTHER PUBLICATIONS

International Search Report Dated Feb. 18, 2011, Mailed Feb. 25, 2011.

* cited by examiner

*Primary Examiner* — Kyle Grobowski
(74) *Attorney, Agent, or Firm* — Norris McLaughlin & Marcus PA

(57) ABSTRACT

It is provided a label for attaching on a packaging, particularly for cosmetical and/or pharmaceutical products, comprising a packaging label with a machine-readable identification code, particularly an EAN-barcode, and a cover label covering at least partially the identification code for rendering the identification code machine-unreadable, wherein the cover label is adapted for irreversibly damaging the identification code. Due to the cover label the identification code is machine-unreadable, so that a scanner cash register would not accept a packaging provided with this label and a resale is prevented. Since the identification code would be irreversibly damaged by the cover label, the identification code stays machine-unreadable even when the cover label is removed. The risk for an unauthorized resale of a packaging can be reduced in a facilitated manner.

11 Claims, 2 Drawing Sheets

LABEL, PACKAGING, USE OF AN ADHESIVE LABEL AND METHOD OF PROVIDING A TEST SAMPLE

Figure 1:
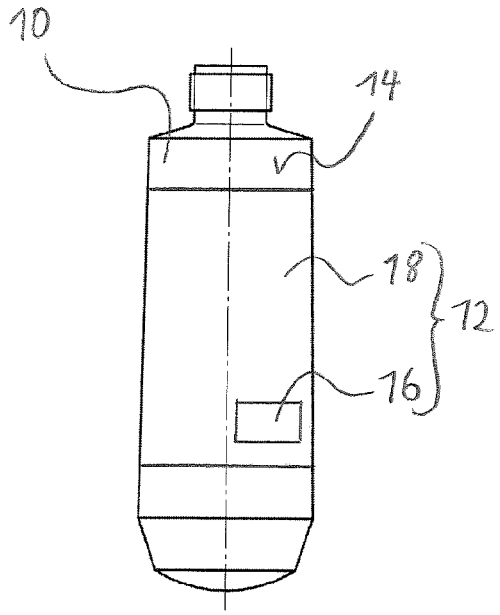

This application is a 371 application of PCT/EP2010/067487 filed Nov. 15, 2010, which claims foreign priority benefit under 35 U.S.C. §119 of European Application No. 09176268.2 filed Nov. 18, 2009.

The invention relates to a label, a packaging, a use of an adhesive label as well as to a method of providing a test sample, by means of which a ready-for-market packaging can be provided as a test sample in such a way that a resale is at least hampered.

From EP 1 345 195 B1 it is known to cover an EAN-barcode of a reusable packaging by a transparent label, wherein the EAN-barcode stays machine-readable after applying the transparent label onto the EAN-barcode. To prevent a double payment of a refund the label is adapted to change its color from transparent to black after a treatment with laser light, so that the EAN-barcode is not machine readable anymore. The EAN-barcode is not affected by the laser light. Due to the black colored label it can be identified that a refund for a particular packaging has already been paid, so that a further payment of a refund by a resale can be prevented.

It is a disadvantage of such a kind of label for a packaging that several different devices are necessary, rendering the handling very complicated. Furthermore a resale of the packaging is not prevented securely, for example when the label is removed carefully.

It is an object of the invention to provide a label, a packaging, a use of an adhesive label as well as a method of providing a test sample, by means of which the risk for an unauthorized resale of a packaging can be reduced in a facilitated manner.

The solution of this object is provided according to the invention by a label according to the features of claim 1, a packaging according to the features of claim 10, an use of an adhesive label according to the features of claim 12 as well as a method of providing a test sample according to the features of claim 14. Preferred embodiments of the invention are given by the dependent claims.

The label according to the invention for attaching on a packaging, particularly for cosmetical and/or pharmaceutical products, like hair treatment means, comprises a packaging label with a machine readable identification code, particularly an EAN-barcode, and a cover label covering at least partially the identification code for rendering the identification code machine unreadable, wherein the cover label is adapted for irreversible damaging the identification code. Due to the cover label, the identification code is machine-unreadable so that a scanner cash register would not accept a packaging provided with this label and a resale is prevented. Since the identification code would be irreversibly damaged by the cover label, the identification code stays machine-unreadable even when the cover label is removed. The risk for an unauthorized resale of a packaging can be reduced in a facilitated manner. Particularly, every provided identification code is at least partially, preferably completely, covered by at least one cover label. Preferably each identification code is covered by one cover label. By means of the cover label a ready-for-sale product can be easily converted into a test sample which is free of charge. It is not necessary to produce a specific product line of test samples for preventing a resale of the test samples. This safeguards that all test samples are used for testing purpose. This leads to a broad data base of test results for improving the quality of the tested product. Particularly in the field of hair treatment products like hair tinting lotions, hair coloration products or shampoos a high number of tests is advantageous for testing new products on different types of hairs and skins. Due to the cover label, a coiffeur would not just sell the test samples but would use all test samples in his shop and recognize the whole outcome of the results using the test sample.

The identification code can be every kind of optical information readable by means of an adequate machine. Preferably the identification code is a barcode, which particularly corresponds to a common standard like EAN, GTIN, UPC or the like. The identification code can comprise alphanumeric characters or even consist of alphanumeric characters adapted for optical character recognition (OCR). By means of the identification code a specific product can be identified for sale and/or trade purposes.

The cover label is particularly designed as adhesive label, which can be easily attached to the packaging label by bonding. The cover label is particularly nontransparent for scanner cash registers. Preferably the cover label is nontransparent for visible light. The cover label is particularly provided for blocking a machine-readable recognition of the identification code. In the case of an intended optically machine-reading of the identification code by means of a scanner the cover label is particularly arranged such, that the cover label is arranged between the identification code and the scanner, when it is tried to scan the identification code by means of the scanner. The cover label can comprise an information field where information is provided particularly for indicating that the product provided with the label is a test sample and not authorized for sale.

The cover label provides its covering function right from the beginning. The identification code is rendered machine-unreadable from the point of time on, when the cover label covers at least partially the identification code. Particularly the cover label covers at least partially the identification code for rendering the identification code machine-unreadable directly after applying the cover label, wherein particularly the cover label is applied directly onto the identification code or a transparent cover film, which is in direct contact to the identification code. In the case of an identification code which is machine readable by optic means, the cover label may comprise at least a colored and/or nontransparent part of its area which is large enough, that the identification code can not be optically scanned anymore with sufficient precision for clearly identifying the identification code. Particularly the whole area of the cover label is colored and/or nontransparent. Preferably the cover label is nontransparent for wavelengths useable for optically scanning the identification code. Particularly the cover label is nontransparent over the whole lifetime of the cover label. Preferably the cover label is nontransparent at any time of the lifetime of the cover label.

An irreversible damage of the identification code is present if after removing the cover label the identification code is not machine-readable. The damage can occur when the cover label is applied to the identification code and/or while the cover label is in contact to the identification code and/or when the cover label is removed. The damage can be inflicted by mechanical and/or chemical means. The irreversible damage of the identification code can be present when by means of the cover label color pigments of the identification code are removed. Further additional color, particularly the same color as used for the identification code, may be applied to the packaging label by means of the cover label. Preferably the packaging label can be destroyed mechanically in the area of the identification code by means of the cover label. For instance, the cover label tears a part of the packaging label out during the removal of the cover label.

The packaging label can be a typical label used for packagings. The packaging label can be an adhesive label, which can be attached to the packaging by bonding. Furthermore, the packaging label can be a band, particularly an elastic packaging band, which can be attached to the packaging by friction.

The packaging can be every kind of container particularly for receiving a fluid and/or granular product, like powder. The packaging can be a packaging material like paper, plastics or the like, which can be wrapped around a product and/or used for shrink-wrap the product. Further the packaging can be the product intended for sale itself.

In a preferred embodiment a bonding strength of the cover label to the identification code is higher than a maximum structural integrity strength of the packaging label in an area of the identification code. The packaging label can be destroyed in the area of the identification code by means of the cover label. For instance, the cover label tears a part of the packaging label out when the cover label is removed. If the packaging label is a multiple layer system, it is sufficient that the layer comprising the identification code is torn out. The maximum structural integrity strength is the mechanical stress perpendicular to the plane of the packaging label at which a split or tear in the material of the packaging label occurs. The bonding strength (force per area) is in particular higher than the maximum structural integrity strength (force per area) by an amount $\Delta p_1$ of 5 $N/mm^2 \leq \Delta p_1 \leq 50$ $N/mm^2$, preferably 10 $N/mm^2 \leq \Delta p_1 \leq 30$ $N/mm^2$, most preferred 15 $N/mm^2 \leq \Delta p_1 \leq 20$ $N/mm^2$. The bonding strength and structural integrity strength are measured at a pressure of 100 kPa, a temperature of 25° C. and a relative humidity of 0% ($p(H_2O)=0$ kPa).

Preferably a bonding strength of the cover label to the identification code is higher than the sum of a structural integrity strength of the packaging label in an area of the identification code and an intended bonding strength of the packaging label to the packaging in an area of the identification code. The bonding strength of the cover label can be adjusted in such a way that the additional resistance against tearing out a part of the packaging label is overcome when the packaging label is designed as adhesive label. If the packaging label is a multiple layer system, it is sufficient that the layer comprising the identification code is torn out. Preferably the packaging label comprises no adhesive in the area of the identification code. The border between the area with adhesive and the area without adhesive can provided with a defined tear when the area without adhesive is torn out by means of the cover label. The bonding strength is in particular higher than the sum of the maximum structural integrity strength and the intended bonding strength of the packaging label by an amount $\Delta p_2$ of 5 $N/mm^2 \leq \Delta p_2 \leq 50$ $N/mm^2$, preferably 10 $N/mm^2 \leq \Delta p_2 \leq 30$ $N/mm^2$, most preferred 15 $N/mm^2 \leq \Delta p_2 \leq 20$ $N/mm^2$. The bonding strengths and structural integrity strength are measured at a pressure of 100 kPa, a temperature of 25° C. and a relative humidity of 0%.

Particularly the packaging label is covered with a protective layer except at least partially in an area of the identification code. By means of the protective layer for instance a protection against environment influences such as humidity can be provided. The protective layer can be a transparent varnish. Due to the lack of the protective layer in the area of the identification code a direct bonding between the cover label and the identification code can be provided. Furthermore, due to the different surface properties of the protective layer and the identification code a higher bonding strength between the cover label and the identification code and/or the area of the packaging label can be provided. Particularly the bonding strength between the cover label and the identification code is significantly higher than the bonding strength between the cover label and the protective layer. Particularly a difference $\Delta p_3$ of the bonding strength between the cover label and the identification code to the bonding strength between the cover label and the protective layer is 10 $N/mm^2 \leq \Delta p_3 \leq 70$ $N/mm^2$, preferably 20 $N/mm^2 \leq \Delta p_3 \leq 50$ $N/mm^2$, most preferred 30 $N/mm^2 \leq \Delta p_3 \leq 40$ $N/mm^2$. The bonding strengths are measured at a pressure of 100 kPa, a temperature of 25° C. and a relative humidity of 0%.

In a further embodiment the packaging label comprises a plurality of perforations for reducing a structural integrity strength of the packaging label in an area of the identification code, wherein particularly a line of perforations surrounding at least partially at least a part of an area of the identification code is provided. Due to the perforations it is facilitated to tear the area of the identification code out by means of the cover label. The perforation can be a hole through the whole thickness of the packaging label. The perforations can be applied during the manufacturing process of the packaging label by punching.

In a preferred embodiment a solvent for dissolving color pigments of the information code and/or for dissolving at least partially the packaging label is provided between the packaging label and the cover label. Due to the solvent the identification code can be damaged by chemical means. Since the color pigments of the information code and/or parts of the packaging label can be dissolved by the solvent, these parts can be retained by the cover label and can be removed together with the cover label. The solvent is particularly an organic solvent like an organic alcohol, especially isopropyl alcohol, an organic ether, especially diethyl ether, acetone, petroleum, a hydrocarbon, especially pentane or cyclohexane, or water in case the color pigments are water soluble.

Preferably a substrate label is located on a surface of the packaging label pointing away from the cover label, wherein particularly the substrate label comprises an information area which is visible when a part of the packaging label is removed by removing the cover label. When the cover label is located on the upper surface of the packaging label, the substrate label is located on the lower surface. The substrate label can provide information particularly for indicating that the product provided with the label is a test sample and not authorized for sale. The information of the substrate label can correspond to the information of the cover label, so that the same information is provided when the cover label is present or removed together with a torn out part of the packaging label. The substrate label can be an additional layer comprising mainly the same shape as the packaging label. Alternatively the substrate label can be provided mainly only where the information code is provided, wherein the substrate label is particularly bigger than the area of the information code, which is intended for being torn out by removing the cover label. The substrate label can be bigger than the window in the packaging label provided by tearing out a part of the packaging label.

Particularly the cover label is bonded to the identification code of the packaging label by an adhesive, wherein the adhesive provides a bonding strength $p_B$ of at least $p_B \geq 15$ $N/mm^2$, particularly $p_B \geq 30$ $N/mm^2$, preferably $p_B \geq 50$ $N/mm^2$ and most preferred $p_B \geq 100$ $N/mm^2$. Such kind of a bonding strength is sufficient in most cases for tearing out a part of the packaging label by removing the cover label. The bonding strength is measured at a pressure of 100 kPa, a temperature of 25° C. and a relative humidity of 0%.

The invention further relates to a packaging, particularly for cosmetical and/or pharmaceutical products like hair treatment compositions, comprising a container for receiving a product and a label attached to the container, wherein the label can be designed as previously described. Due to the cover label the identification code is machine-unreadable, so that a scanner cash register would not accept a packaging provided with this label and a resale is prevented. Since the identification code would be irreversibly damaged by the cover label, the identification code stays machine-unreadable even when the cover label is removed. The risk of an unauthorized resale of a packaging can be reduced in a facilitated manner. The packaging can be designed further as described above with respect to the label.

The invention further relates to a packaging, particularly for cosmetical and/or pharmaceutical products like hair treatment packaging, comprising a container for receiving a product, a machine-readable identification code, particularly an EAN-barcode, printed on the container and a cover label covering at least partially the identification code for rendering the identification code machine unreadable, wherein the cover label is adapted for irreversibly damaging the identification code. The irreversible damage of the printed identification code is particularly provided by chemical means only, like applying additional color or removing the color of the identification code. Due to the cover label the printed identification code is machine-unreadable, so that a scanner cash register would not accept a packaging provided with this label and a resale is prevented. Since the printed identification code would be irreversibly damaged by the cover label, the identification code stays machine-unreadable even when the cover label is removed. The risk of an unauthorized resale of a packaging can be reduced in a facilitated manner. The packaging can be designed further as described above with respect to the label.

In particular, a solvent for dissolving color pigments of the information code is provided between the container and the cover label. Preferably the printed information code is damaged by chemical means only, so that a mechanical damage of the package itself is prevented.

The invention further relates to a use of an adhesion label for irreversibly damaging at least partially a machine readable identification code, particularly an EAN-barcode. In particular, the identification code is part of a label which can be designed as previously described, or part of an packaging which can be designed as previously described. Due to the adhesive label the identification code is machine-unreadable, so that a scanner cash register would not accept a packaging provided with this label and a resale is prevented. Since the identification code would be irreversibly damaged by the adhesive label, the identification code stays machine-unreadable even when the cover label is removed. The risk of an unauthorized resale of a packaging can be reduced in a facilitated manner. The use of the adhesive label can be designed further as described above with respect to the label and/or with respect to the packaging.

The invention further relates to a method for providing a test sample of a ready for market packaging, comprising the steps of providing a packaging comprising a machine-readable identification code, particularly an EAN-barcode, and attaching a cover label at least partially over the identification code for rendering the identification code machine-unreadable, wherein the cover label is adapted for irreversible damaging the identification code. Due to the cover label the identification code is machine unreadable, so that a scanner cash register would not accept a packaging provided with this label and a resale is prevented. Since the identification code would be irreversibly damaged by the cover label, the identification code stays machine-unreadable even when the cover label is removed. The risk of an unauthorized resale of a packaging can be reduced in a facilitated manner. The method can be designed further as described above with respect to the label and/or with respect to the packaging and/or with respect to the use of an adhesive label.

Particularly the identification code is irreversibly damaged by removing the cover label from the packaging. The damage to the identification label may occur only at a later time during removing the cover label. If the cover label is not removed the identification code may be not be damaged but only be covered by the cover label. An intentional damage can be provided only in the case of an unauthorized manipulation, when the cover label is removed without permission.

In the following the invention is explained in detail by example with reference to the enclosed drawings showing preferred embodiments of the present invention.

Figure 2:
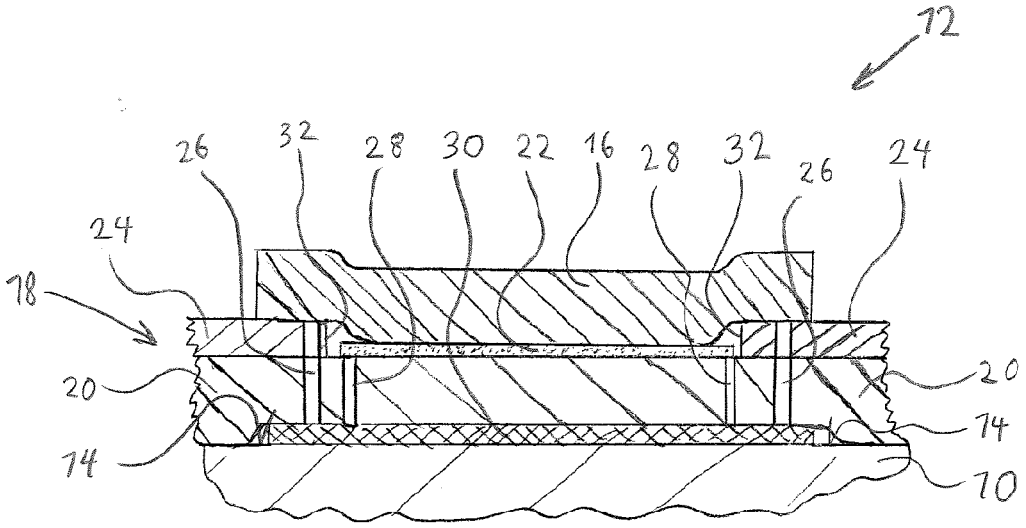
Figure 3:
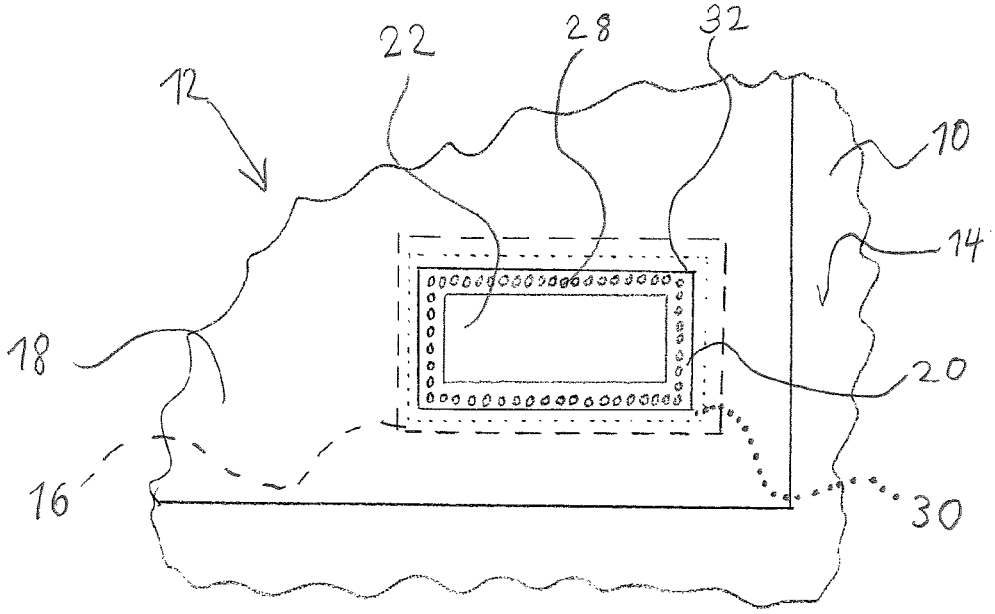

FIG. 1: shows a schematic view of a packaging with a label,

FIG. 2: shows a schematic cross sectional view of the label of FIG. 1,

FIG. 3: shows a partial schematic top view of the package of FIG. 1 without cover label.

The packaging 10 as illustrated in FIG. 1 is a container for receiving a hair coloration powder. A label 12 is attached by means of an adhesive to an outer surface 14 of the packaging 10. The label 12 comprises an adhesive cover label 16, which is bonded to a packaging label 18 of the label 12, wherein the packaging label 18 covers the majority of the surface 14 in the illustrated embodiment.

As illustrated in FIG. 2 the packaging label 18 comprises a base layer 20, which is printed with an identification code 22, particularly a barcode. Alternatively, the identification code 22 may be printed directly on the packaging 10. In the illustrated embodiment the base layer 20 is covered by a protective layer 24 except in the area of the identification code 22. The cover label 16 is attached by an adhesive (not illustrated) to the packaging label 18 and is in direct contact via the adhesive to the protection layer 24 and the identification code 22. Due to the lacking protective layer 24 in the area of the identification code 22 the cover label 16 may be pressed inwards in the area of the identification code 22. For facilitating the tearing out of a part of the packaging label 18 in the area of the identification code 22 it is provided a first set of perforations 26 punched through the base layer 20 and the protective layer 24 and/or a second set of perforations 28 not punched through the protective layer 24 but through the base layer 20 only or punched through the base layer 20 and the identification code 22. In the illustrated embodiment a substrate label 30 is located between the base layer 20 and the packaging 10. The substrate label 30 covers a window, which would occur when the cover label 16 tears a part of the packaging label 18 out during removing the cover label 16. The substrate label 30 can be pressed into the base layer 20 so that no significant difference in the thickness of the packaging label 18 occurs by the presence of the substrate label 30. The cover label 16 and/or the substrate label 30 can comprise an information field where information is provided particularly for indicating that the product provided with the label 12 is a test sample and not authorized for sale. If the packaging label 18 is designed as adhesive label the not illustrated adhesive of the packaging label 18 can be covered by a not illustrated protective sheet as long as the label 12 is not attached to the packaging 10.

As illustrated in FIG. 3 the perforations 28 may enclose the whole area of the identification code 22. In the illustrated embodiment the perforations 28 are located in an area, where no protection layer 24 is provided. The substrate label 30 covers the whole area, where no protection layer 24 is provided, and extends slightly outwards over a border 32 of the protection layer 24. In the illustrated embodiment the cover label 16 may cover and extend the area provided by the substrate label 30. When the cover label 16 is significantly larger than the area of the identification code 22, it is facilitated to provide the packaging label 18 with the cover label 16 by hand.

The invention claimed is:

1. A label system comprising;

a packaging label with a machine-readable identification code, wherein the packaging label is covered with a protective layer except directly above the area of the identification code, the protective layer surrounding the identification code and a cover label adapted to cover at least partially the identification code and render the identification code machine-unreadable, wherein the cover label is adapted for irreversibly damaging the identification code.

2. The label according to claim 1, wherein a bonding strength of the cover label to the identification code is higher than a maximum structural integrity strength of the packaging label in an area of the identification code.

3. The label according to claim 1, wherein the packaging label comprises a plurality of perforations for reducing a structural integrity strength of the packaging label in an area of the identification code, wherein a line of perforations surrounding at least partially at least a part of an area of the identification code is provided.

4. The label according to claim 1, wherein a solvent for dissolving color pigments of the information code and/or for dissolving at least partially the packaging label is provided between the packaging label and the cover label.

5. The label according to claim 1, wherein a substrate label is located on a surface of the packaging label pointing away from the cover label, wherein the substrate label comprises an information area, which is visible when a part of the packaging label is removed by removing the cover label.

6. The label according to claim 1, wherein the cover label is bonded to the identification code of the packaging label by an adhesive, wherein the adhesive provides a bonding strength $p_B$ of at least $p_B \geq 15\ N/mm^2$.

7. A packaging, comprising a container and the label according to claim 1, wherein the label is attached to the container.

8. The packaging according to claim 7, comprising a container for receiving a product.

9. The packaging according to claim 8, wherein a solvent for dissolving color pigments of the information code is provided between the container and the cover label.

10. A method for providing a test sample of a ready-for-market packaging, comprising the steps of:

providing a packaging label comprising a machine-readable identification code, wherein the packaging label is covered with a protective layer except directly above the area of the identification code, the protective layer surrounding the identification code and attaching a cover label at least partially over the identification code for rendering the identification code machine-unreadable, wherein the cover label is adapted for irreversibly damaging the identification code.

11. A method according to claim 10, wherein the identification code is irreversibly damaged by removing the cover label from the packaging.

* * * * *